United States Patent [19]

Smit

[11] Patent Number: 4,529,506

[45] Date of Patent: Jul. 16, 1985

[54] METHOD FOR CLEANING FINE COAL

[75] Inventor: Francis J. Smit, Arvada, Colo.

[73] Assignee: AMAX Inc., Greenwich, Conn.

[21] Appl. No.: 520,894

[22] Filed: Aug. 8, 1983

[51] Int. Cl.[3] ..... B03B 7/00

[52] U.S. Cl. ..... 209/13; 209/172; 209/173; 209/211

[58] Field of Search ..... 209/1, 3, 4, 12, 13, 209/18, 171, 172, 172.5, 173, 211; 210/729, 748, 210/787

[56] References Cited

U.S. PATENT DOCUMENTS

| | | | |
|---|---|---|---|
| 1,656,270 | 1/1928 | Downs et al. | 209/172.5 |
| 2,109,234 | 2/1938 | Keenan | 209/172 |
| 2,571,835 | 10/1951 | Cleeman | 209/172.5 |
| 2,896,922 | 7/1959 | Pohlman | 209/1 |
| 2,907,455 | 10/1959 | Sasaki | 210/748 |
| 3,992,288 | 11/1976 | Kling | 209/3 |
| 4,252,639 | 2/1981 | Smith et al. | 209/172 |
| 4,410,423 | 10/1983 | Walsh | 209/4 |

FOREIGN PATENT DOCUMENTS

| | | | |
|---|---|---|---|
| 2046630 | 11/1980 | United Kingdom | 209/172.5 |

*Primary Examiner*—Bernard Nozick

*Attorney, Agent, or Firm*—Roland T. Bryan

[57] ABSTRACT

A method for cleaning fine coal is provided which includes: mixing the coal with a fluid of such a specific gravity that clean coal particles would float while refuse particles would sink therein, pretreating the coal-fluid slurry by adding a surfactant, subjecting the mixture to ultrasonic dispersion, and separating the entire mixture into higher and lower specific gravity fluid streams by means of centrifugal separation. The fluid of the chosen specific gravity and the surfactant may be recovered from the fluid streams and recycled if desired.

13 Claims, 1 Drawing Figure

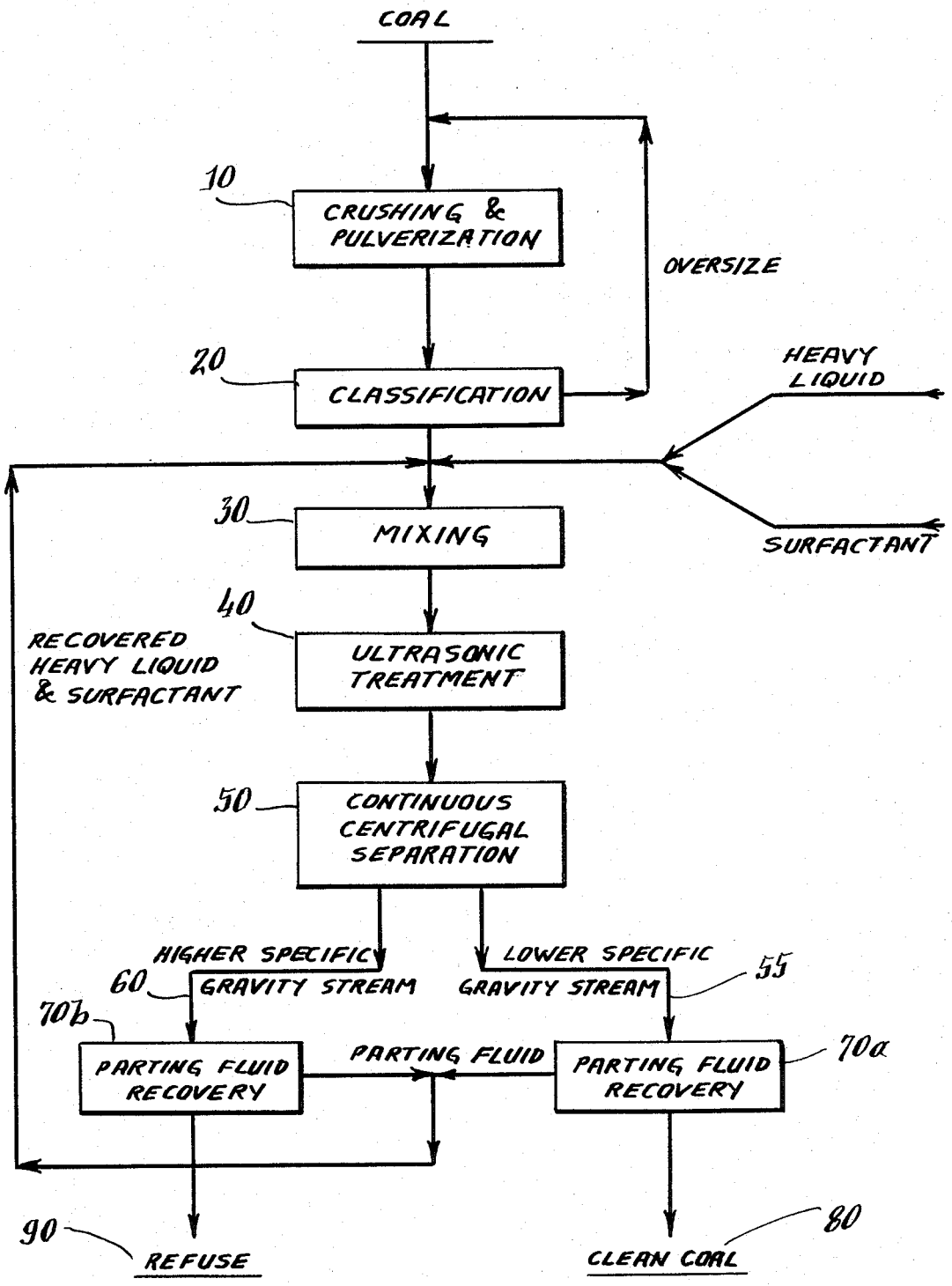
COAL
10
CRUSHING & PULVERIZATION
OVERSIZE
20
CLASSIFICATION
HEAVY LIQUID
30
MIXING
SURFACTANT
40
RECOVERED HEAVY LIQUID & SURFACTANT
ULTRASONIC TREATMENT
50
CONTINUOUS CENTRIFUGAL SEPARATION
HIGHER SPECIFIC GRAVITY STREAM
LOWER SPECIFIC GRAVITY STREAM
60
55
70b
PARTING FLUID RECOVERY
PARTING FLUID
PARTING FLUID RECOVERY
70a
90
REFUSE
CLEAN COAL
80

METHOD FOR CLEANING FINE COAL

BACKGROUND OF THE INVENTION

One manner of reducing air pollution resulting from the burning of coal is to clean the coal of ash and minerals before burning. Not only is pollution decreased but the efficiency of burning is higher if refuse can be separated from the coal. Moreover, if the sulfur content of coal can be reduced before burning, great benefit is obtained as the emission of sulfur gases resulting from the burning of coal is limited to specified amounts according to law. Thus, it has been an objective of the coal industry to produce a low ash, low sulfur, clean coal through processing.

Different methods and apparatus have been used in pursuit of the objective of producing low ash, clean coal. Most of these methods and apparatus make use of the fact that the physical separation rate of particles in fluid is proportional to the mass of the particle being acted upon, to the magnitude of the the driving force (gravity, magnetic, electrical, etc.) acting upon the particle, and inversely proportional to the resistance of the surrounding fluid to the particle motion and to the distances through which the particle must move to complete the separation.

Among these separation methods is the method of selective flocculation wherein the mass of either the coal or mineral particles is enlarged either magnetically or chemically. Selective flocculation is often carried out in a liquid environment which increases the efficiency of flotation, oil agglomeration, density, magnetic, and most other separations.

Electrostatic separation operates in the air rather than in liquid, and this relatively decreases the resistance term which is inversely proportional to the separation rate. Electrostatic separation rates may also be increased by increasing the driving force (voltage) between the electrodes and ground.

Closely akin to electrostatic separation is electophoretic separation wherein charged particles are suspended in a liquid media. This mechanism is utilized to apply certain coatings to the particles. The resistance term, which was advantageous when the medium was air in the electrostatic separation process, is compensated for by supplying closely spaced electrodes.

Non-aqueous media may be used advantageously to enhance separation. By choosing the liquid used, the resistance (viscosity) of the liquid can be kept small, with the electrical properties thereby being able to increase the driving force. Since organic liquids have much lower heats of vaporization than water, the processing in non-aqueous media may be advantageous if a dried product is needed.

A disc or a decanter centrifuge may be useful for fine coal cleaning if a fluid is used which has a density between that of coal and the mineral matter (refuse). The centrifuge permits much higher forces than allowed by gravity or cyclone separations, and the closely spaced discs of the disc centrifuge permit the particles to separate without moving a great distance. One drawback of the disc centrifuge, however, is that the coal input must be very fine so as to avoid plugging and erosion.

Various flotation methods such as electroflotation, dissolved air flotation, air-sparged cyclones etc. have also been proposed. These methods emphasize a close contact between particle and newly forming bubbles. The air-sparged cyclone also features a very short distance of travel for the loaded bubble between its origin and overflow.

All of the various above listed methods, as well as other techniques such as chemical cleaning processes have different benefits depending on the degree of cleaning and the make-up of the end product required. However, all suffer from various technological difficulties as well as other well known drawbacks. Additionally, as many of the methods compete, the cost of the different methods for cleaning fine coal is an important consideration.

It is therefore, an object of the invention to provide a novel method for the removal of mineral matter and ash from fine particle coal in an economical manner.

A further object of the invention is to increase the weight fraction of fine coal recovery while decreasing the ash and sulfur content by pretreatment of the slurry of coal immersed in heavy liquid prior to centrifugal separation.

Yet a further object of the invention is to provide an improved method for the cleaning of fine coal whereby the slurry of coal immersed in heavy liquid is pretreated by both the addition of a surfactant and the use of ultrasonic dispersion prior to centrifugal operation.

It is even another object of the invention to provide an improved method for the cleaning of fine coal where the coal and refuse particles are all less than 0.075 mm. in size and where a coal heavy liquid slurry is pretreated prior to a centrifugal separation.

SUMMARY OF THE INVENTION

In one embodiment of the invention, in accordance with the objects of the invention, dry coal is crushed, pulverized and classified to provide particles of less than 0.075 mm in size (defined, for purposes of this invention as "fine coal"). The coal and the refuse contained therewith is mixed with a fluid of a pre-chosen specific gravity. The resulting slurry is pretreated by the addition of a surfactant which is soluble in the added specific-gravity fluid and which is compatible with coal, and by subjecting the entire contents, after mixing, to ultrasonic treatment. After the described pretreatment, the contents are subjected to a continuous centrifugal separation in a disc or a decanter centrifuge or a small diameter hydrocyclone. Resulting higher and lower specific gravity streams are filtered and/or evaporated and condensed to provide clean coal, refuse and recovery of the specific-gravity fluid for further use.

The weight fraction of recovered coal according to the method invention is increased relatively sharply, sometimes by more than 50%, due to the pretreatment of the coal according to the invention, and the ash content of recovered coal may be reduced by more than 25%.

The decision of what fluid to mix with the coal to form a slurry for pretreatment is influenced by the specific gravity of the fluid. The specific gravity is a matter of choice depending on the process and apparatus to be used for separating the refuse from the coal. In general the fluid media would be selected to provide a specific gravity intermediate that of the clean coal particles and the refuse particles. Chlorinated hydrocarbons have been found to be advantageous for those purposes. Chlorofluorocarbon compounds are especially useful in these circumstances due to their low viscosity and the ease at which they may be recovered for reuse by the processes of steam distillatiion, vapor compression, refrigeration and condensation.

BRIEF DESCRIPTION OF THE DRAWINGS

FIG. 1 illustrates in flow chart form the preferred embodiment of the method invention.

DETAILED DESCRIPTION OF THE PREFERRED EMBODIMENT

The coal which is cleaned according to the present invention is preferably bituminous coal, but all types of coal may be treated. Therefore, for convenience, the invention will be described using the term "coal", it being understood that the term is intended to include the foregoing materials.

According to the method invention for cleaning fine coal, dry coal is crushed and pulverized at step 10. The coal is pulverized to obtain minus 0.075 mm coal, although according to the best mode embodiment fine coal of size 400 mesh (0.038 mm×0 or smaller×0) is preferable in practicing the invention. The pulverized coal is screened or classified, preferably by means of a sieve at 20, and oversized particles are returned for further pulverization. Metal particles are removed, and discarded if desired.

Upon obtaining suitable fine coal, a solution of a predetermined specific gravity and a surfactant are added at 25 to form a slurry. As detailed hereinafter, the specific gravity of the solution is determined according to the method of centrifugal separation chosen for separating the clean coal from the refuse i.e. a disc or a decanter centrifuge or hydrocyclone.

It has been found that a 1.4 specific gravity Certigrav solution is well-suited for carrying out the method invention. Certigrav solution is a product of American Minchem Corporation, Coraopolis, PA, and is comprised of unsubstituted hydrocarbons (naptha solvents or petroleum spirts) as well as chlorinated hydrocarbons. It is also contemplated that other fluids of suitable specific gravity would be suitable such as liquid chlorofluorocarbon compounds including Freon 11 or Refrigerant R-211, aqueous solutions of metal salts such as calcium chloride or zinc sulfate, and slurries of finely-divided, high density solids such as ferrosilicon or magnetite in a suitable carrier liquid. Chlorofluorocarbon compounds are especially advantageous due to their low viscosities and the ease at which they may be recovered for reuse via steam distillation, vapor compression, refrigeration and condensation.

For each kilogram of fine coal, approximately 20 liters of 1.4 specific gravity Certigrav fluid is needed to form a slurry. It has been found that as a pretreatment to centrifugal separation it is particularly advantageous to add a surfactant to the specific gravity fluid, and after mixing with the fine coal to subject the resulting slurry to ultrasonic treatment. Although it is not desired to be limited to this theory or explanation, it is hypothesized that the pretreatment of the slurry by the combination of the addition of the surfactant and the ultrasonic treatment acts to effectively disperse the fine coal and refuse particles in the specific gravity solution. It is believed that this improved dispersion permits the separating process to be accomplished more effectively such that a more complete recovery of coal particles with a lower amount of ash and other refuse particles therein is obtained. For these purposes any surfactant soluble in the specific gravity fluid and compatible with coal may be used, although it has been found that anionic surfactants are especially suited. For example, anionic surfactant Aerosol OT-S comprised of a dioctyl ester of sodium sulfosuccinic acid dissolved in mineral spirits and produced by American Cyanamid Company, Wayne, N.J. has been found to be useful in Certigrav solution. A concentration of 500 ppm of the surfactant in the specific gravity solution has provided desirable results and has been found to be beneficial for dispersing the fine coal and mineral-matter particles in the Certigrav solution. However, concentration as low as 200 ppm have provided consistent and improved results.

In the preferred embodiment of the invention, after the fine coal and the combination 1.4 specific gravity fluid and dispersant reagent surfactant are mixed together at 30, the slurry undergoes additional pretreatment by subjecting it to ultrasonic dispersion treatment at 40. Any suitable equipment may be utilized for the ultrasonic treatment provided, however, that enhanced dispersion results. Thus, it has been found that equipment having an output frequency of 55,000 cycles per second has been suitable. The length of ultrasound treatment required could change according to the frequency selected. However, at 55,000 cps, a two minute ultrasonic treatment was determined to be satisfactory.

The pretreated slurry may then be subjected to a continuous centrifugal separation at 50 as is well known in the art. Centrifugal assisted specific gravity separation is preferable to the simpler float-sink gravity methods for the separation of less than 0.5 mm particles. Since the particles of fine coal were pulverized to a size of 0.075 mm or smaller, small diameter hydrocyclones or disc or decanter centrifuges are preferable for separating the coal from the refuse. Both are capable of continuous separation and discharge of low and high specific gravity fluid streams, and are particularly advantageous as the particles would not have to move laterally any great distance from the center of the main fluid flow to effect a separation.

As aforementioned, the specific gravity of the heavy liquid fluid used is determined in part by the method of separation chosen. It is preferred that there be high speed centrifugal separation, and best results are obtained when the fluid media has a specific gravity intermediate that of clean coal particles and the refuse particles. Thus, when using a centrifuge, a specific gravity of 1.4 may be chosen. The value selected, as is known to those in the art, is also dependent on the speed in rotation per minute of the centrifuge. Thus, in certain other cases, such as when using hydrocyclones, a fluid of specific gravity somewhat less than that of the coal may be useful for separating mixtures when the higher specific gravity compound (refuse) tends to be the same particle size or coarser than the lower specific-gravity solid component (coal).

At 50, the slurry undergoes separation. Both the volume of input into the separator, as well as the speed of rotation must be closely monitored as those skilled in the art will appreciate. The resulting lower specific gravity stream 55 and higher specific gravity stream 60 are then sent for postprocessing 70*a* and 70*b* to recover the heavy liquid-surfactant fluid mixture which may be recycled back for mixing with the fine coal to produce the slurry. The heavy liquid-surfactant fluid mixture may be recovered by standard filtration techniques and/or by evaporation/condensation techniques as are well known in the art. The reuse of the parting fluid mixture is both economically and environmentally advantageous.

After recovery of the fluid mixture from higher specific gravity stream 60 and lower specific gravity stream 55, the residue of the streams are a clean, low-ash fine coal 80 from stream 55 and the refuse 90 which contains ash, metals, etc. from stream 60. Coal 80 is of an improved quality and contains less ash and sulfur than that coal which was washed by similar prior art methods not implementing the surfactant and ultrasonic pretreatment. Additionally, the coal weight recovery is strikingly improved in comparison to the prior art methods.

EXAMPLE 1

Indiana No. VII coal from the Minnehaha mine was pulverized to a particle size of 0.038 mm×0. The coal was separated into separate batches for control testing. In all the batches, approximately 10 grams of coal were added to about 200 ml of 1.4 specific gravity Certigrav solution. Different batches of slurry underwent six different procedures, all procedures ending with separation in a batch centrifuge. The only preparation for batch A was some stirring prior to separation in a batch centrifuge. Batches B and C had Aerosol OT-S added to the Certigrav solution in the amount of 100 ppm. These batches did not undergo ultrasonic treatment. Batch D underwent ultrasonic treatment in a water bath for two minutes at 55,000 cps, but no surfactant was added. Batch E had 100 ppm of Aerosol OT-S added and was subjected to the same ultrasonic treatment of batch D. Batch F was pretreated with 500 ppm of the Aerosol OT-S surfactant, but did not undergo ultrasound treatment. Finally, batches G and H were pretreated with 500 ppm of Aerosol OT-S surfactant and the same ultrasonic treatment of batch D, in accordance with the teachings of the invention. The results, after analysis were as follows:

Weight Fraction Recovery, and Ash Content for .038 mm × 0 Indiana No. VII Coal From The Minnehaha Mine

| | | 1.4 Specific Gravity Float | |
|---|---|---|---|
| Batch | Pretreatment | Wgt. Fraction % | Ash % |
| A | — | 38.3 | 4.12 |
| B | 100 ppm Aerosol OT-S | 40.3 | 3.92 |
| C | 100 ppm Aerosol OT-S | 41.4 | 3.36 |
| D | Ultrasonic treatment | 39.3 | 3.79 |
| E | 100 ppm Aerosol OT-S and ultrasonic treatment | 41.5 | 3.68 |
| F | 500 ppm Aerosol OT-S | 38.3 | 3.32 |
| G | 500 ppm Aerosol OT-S | 64.1 | 3.01 |
| H | and ultrasonic treatment | 58.9 | 3.16 |
| | Average of A–F controls | 39.9 | 3.70 |

-continued

Weight Fraction Recovery, and Ash Content for .038 mm × 0 Indiana No. VII Coal From The Minnehaha Mine

| | | 1.4 Specific Gravity Float | |
|---|---|---|---|
| Batch | Pretreatment | Wgt. Fraction % | Ash % |
| | Average of G and H | 61.5 | 3.09 |

Batches G and H show an average coal recovery increase of greater than 50% over the average of the control batches while the average ash content of the recovered coal decreased by over 16%.

EXAMPLE 2

Pittsburgh No. 8 seam coal with an average ash content of 6.48%, total sulfur content of 4.37% and BTU/lb content of 14,062 BTU/lb was dry-ground in stages by ball-milling to both a 0.038 mm×0 (400 mesh×0) and a 0.025 mm×0 size. A shaking 8 inch test sieve for the 0.038 mm coal and an Alpine Air-jet sieve for the 0.025 mm coal were used for top size control, and coarse metals were discarded with the tramp oversize. Ten gram samples of each sized coal were placed in 250 milliliter centrifuge tubes and 200 milliliters of Certigrav solution containing 500 ppm of the surfactant Aerosol OT-S was added to each sample. The samples were mixed to form a slurry and were placed in an ultrasonic bath. The ultrasonic treatment was carried out with a Branson Cleaning Equipment Co., Shelton, Ct, Model B-12 1 quart ultrasonic cleaner, with a fixed output of 50 watts at a frequency of 55,000 cps. The tank was filled with about 500 ml of water during use, and the 250 ml glass centrifuge tubes were held in the water bath for two minutes with the ultrasonic power on.

After pretreatment (by the addition of a surfactant and by ultrasonic treatment) each sample was centrifuged for 45 minutes at 2200 rpm (1280 g-force). The separated slurry so obtained was gently stirred to break up any surface agglomeration and the sediment on the bottom with as little vertical mixing as possible. The ultrasonic treatment and centrifuge separation were repeated and the resultant float was skimmed into a filter paper media and a 0.45 micrometer Millipore filter for the 400 mesh and 0.025 mm coal respectively. The sink was washed into a filter with Certigrav solution. The float and sink products were then dried in air at 38° centrigrade and weighed. A full washability series at different specific gravities was performed, starting with a fresh sample of pulverized coal for the separation at each specific gravity. Analyses of intermediate specific gravity fractions were calculated by taking differences:

| Spec. Gravity | | Calculated Direct Product (Dry Basis) | | | | | | | Cumulative Float product (Dry Basis) | | | | | | |
|---|---|---|---|---|---|---|---|---|---|---|---|---|---|---|---|
| | | | Ash | | S (Total) | | Calorific Value | | | Ash | | S (Total) | | Calorific Value | |
| Sink | Float | Wght. % | % | Dist % | % | Dist % | Btu/lb | Dist % | Wght. % | % | Dist % | % | Dist % | Btu/lb | Dist % |
| DISTRIBUTION OF WEIGHT, ASH, SULFUR AND CALORIFIC VALUE FOR 400 MESH × 0 (0.38 mm × 0) PITTSBURGH NO. 8 SEAM COAL | | | | | | | | | | | | | | | |
| | 1.30 | 29.96 | 1.27 | 6.86 | 2.30 | 18.04 | 14,972 | 31.98 | 29.96 | 1.27 | 6.86 | 2.30 | 18.04 | 14,972 | 31.98 |
| 1.30 | 1.40 | 58.86 | 3.37 | 35.71 | 2.12 | 32.64 | 14,608 | 61.29 | 88.82 | 2.66 | 42.57 | 2.18 | 50.68 | 14,731 | 93.27 |
| 1.40 | 1.50 | 5.21 | 10.60 | 9.95 | 2.36 | 3.22 | 12,655 | 4.70 | 94.03 | 3.10 | 52.52 | 2.19 | 53.90 | 14,616 | 97.97 |
| 1.50 | 1.65 | 1.47 | 16.74 | 4.43 | 8.69 | 3.34 | 8,314 | 0.87 | 95.50 | 3.31 | 56.95 | 2.29 | 57.24 | 14,519 | 98.84 |
| 1.65 | | 4.50 | 53.07 | 43.05 | 36.29 | 42.76 | 3,608 | 1.16 | | | | | | | |
| | Total Coal | | | | | | | | 100.00 | 5.55 | 100.00 | 3.82 | 100.00 | 14,028 | 100.00 |
| DISTRIBUTION OF WEIGHT, ASH, SULFUR AND CALORIFIC VALUE FOR 0.025 mm × 0 PITTSBURGH NO. 8 SEAM COAL | | | | | | | | | | | | | | | |
| | 1.30 | 14.37 | 0.93 | 2.19 | 2.33 | 9.08 | 14,897 | 15.16 | 14.37 | 0.93 | 2.19 | 2.33 | 9.08 | 14,897 | 15.16 |
| 1.30 | 1.40 | 68.66 | 2.43 | 27.38 | 2.33 | 43.40 | 14,717 | 71.58 | 83.03 | 2.17 | 29.57 | 2.33 | 52.45 | 14,748 | 86.74 |

-continued

| Spec. Gravity | | Calculated Direct Product (Dry Basis) | | | | | | | Cumulative Float product (Dry Basis) | | | | | | |
|---|---|---|---|---|---|---|---|---|---|---|---|---|---|---|---|
| | | | Ash | | S (Total) | | Calorific Value | | | Ash | | S (Total) | | Calorific Value | |
| Sink | Float | Wght. % | % | Dist % | % | Dist % | Btu/lb | Dist % | Wght. % | % | Dist % | % | Dist % | Btu/lb | Dist % |
| 1.40 | 1.50 | 9.83 | 10.77 | 17.37 | 2.05 | 5.45 | 13,123 | 9.11 | 92.86 | 3.08 | 46.94 | 2.30 | 57.93 | 14,573 | 95.85 |
| 1.50 | 1.65 | 1.82 | 19.73 | 5.89 | 12.18 | 6.02 | 10,099 | 1.31 | 94.68 | 3.40 | 52.83 | 2.49 | 63.95 | 14,487 | 97.16 |
| 1.65 | | 5.32 | 54.02 | 47.17 | 24.79 | 36.05 | 7,495 | 2.84 | | | | | | | |
| | Total Coal | | | | | | | | 100.00 | 6.09 | 100.00 | 3.69 | 100.00 | 14,115 | 100.00 |

If a specific gravity float of 1.4 were chosen for the separation process for 0.025 mm coal, over 83% of the coal would be recovered with an ash content of approximately 2.17% (a decrease of approximately two-thirds), a sulfur content of 2.33 (a decrease of over 46%) and a calorific content of 14,748 BTU/lb, which is an increase of almost 5% over the feed coal calorific content and which partially offsets the decreased amount of coal (albeit cleaner) available for burning.

Similarly for the 0.038 mm coal, using the 1.40 specific gravity liquid almost 89% of the coal was recovered with an ash value of 2.66% (a decrease of almost 59%), a sulfur value of 2.18% (a decrease of 50%), and a calorific content of 14,731 BTU/lb which amounts to almost a 5% increase per pound over the feed coal calorific content.

Those skilled in the art will appreciate that many variations and permutations may be made on the disclosed embodiments while falling within the scope of the invention. Thus, at step 30, the heavy liquid and the surfactant may be added separately. Moreover, as aforementioned, different heavy liquids with different specific gravities may be utilized, as well as different surfactants and a plethora of different separation means with varying speeds of rotation. Further, the ratio of coal to heavy liquid surfactant in the slurry may be varied widely.

The invention may also be embodied with a partial feedback of the higher specific gravity "refuse" stream 60 along with the heavy liquid-surfactant mixture recovered from the lower specific gravity stream 55.

If desired, in accord with the embodiment suggested by Example 2, the feedback stream, instead of being mixed with a heavy liquid of the original specific gravity, can be mixed with a fluid of higher specific gravity before pretreatment. In this manner, after pretreatment and separation, secondary coal products may be obtained having a higher ash and sulfur content than the clean coal obtained in the lower specific gravity pass, but possibly of lesser ash and/or sulfur content than the original coal feed.

While the present invention has been described in connection with the preferred embodiments thereof, it is to be understood that additional embodiments, modifications, and applications which will be apparent to those skilled in the art are included within the spirit and scope of the invention as described in the specification and set forth in the appended claims.

I claim:

1. A method for cleaning fine coal of refuse comprising: mixing said fine coal composed of a mixture of clean coal particles and refuse particles with a heavy liquid having a specific gravity generally intermediate that of the clean coal particles and the refuse particles to form a slurry; pretreating said slurry, wherein said pretreating includes (a) adding a surfactant as an ingredient in said mixing step such that said slurry includes said surfactant;

(b) subjecting the fine coal heavy liquid surfactant slurry to ultrasonic treatment at a frequency of generally 55,000 cps for dispersing the clean coal particles and the refuse particles; and separating said refuse particles from said fine coal particles by centrifugal separation.

2. A method according to claim 1 wherein said heavy liquid is selected from the group consisting of chlorinated hydrocarbons, liquid chlorofluorocarbon compounds, aqueous solutions of metal salts, and slurries of finely divided high density solids in a carrier liquid.

3. A method according to claim 1 wherein said heavy liquid is selected from the group consisting of chlorinated hydrocarbons and liquid chlorofluorocarbon compounds.

4. A method according to claim 1 wherein said surfactant is an anionic surfactant compatible with coal and soluble in said heavy fluid.

5. A method according to claim 1 wherein said centrifugal separation of said separating step is accomplished by means of a disc centrifuge.

6. A method according to claim 1 wherein said centrifugal separation of said separating step is accomplished by means of a decanter centrifuge.

7. A method according to claim 1 wherein said centrifugal separation of said separating step is accomplished by means of hydrocyclone.

8. A method according to claim 1 wherein a first specific gravity stream containing primarily said clean coal particles, said heavy liquid and said surfactant, and a second specific gravity stream containing primarily said refuse particles, said heavy liquid and said surfactant result from said centrifugal separation, further comprising:

recovering said heavy liquid, and said surfactant from said first specific gravity stream; recycling said recovered heavy liquid and surfactant for mixing with the fine coal to product the slurry; and recovering and recycling said second specific gravity stream for mixing with more of said fine coal, said heavy liquid, and said surfactant in said mixing step.

9. A method according to claim 1 for cleaning fine coal of refuse wherein a first specific gravity stream containing primarily said clean coal particles, said heavy liquid and said surfactant, and a second specific gravity stream containing primarily said refuse particles, said heavy liquid and said surfactant result from said centrifugal separation, further comprising:

recovering said heavy liquid and said surfactant from said lower and higher specific gravity streams.

10. A method according to claim 9 further comprising: recycling said recovered heavy liquid and surfactant for mixing with the fine coal to produce the slurry.

11. A method according to claim 1 wherein said surfactant is added such that its concentration in said heavy liquid is generally between 200 ppm and 500 ppm.

12. A method according to claim 11 wherein the relative amounts of fine coal to heavy liquid in said slurry is about one liter of heavy liquid to 50 grams of fine coal.

13. A method according to claim 12 wherein the specific gravity of said heavy liquid is in the range of 1.30 to 1.65.

* * * * *